US007276850B2

(12) United States Patent
Chung

(10) Patent No.: US 7,276,850 B2
(45) Date of Patent: Oct. 2, 2007

(54) PLASMA DISPLAY PANEL HAVING TRENCHES IN FUNCTIONAL LAYER

(75) Inventor: Jae Sang Chung, Seongnam-si (KR)

(73) Assignee: LG Electronics Inc., Seoul (KR)

( * ) Notice: Subject to any disclaimer, the term of this patent is extended or adjusted under 35 U.S.C. 154(b) by 108 days.

(21) Appl. No.: 11/000,010

(22) Filed: Dec. 1, 2004

(65) Prior Publication Data

US 2005/0140299 A1 Jun. 30, 2005

(30) Foreign Application Priority Data

Dec. 31, 2003 (KR) ..... 10-2003-0102319

(51) Int. Cl.
*H01J 17/49* (2006.01)

(52) U.S. Cl. ..... 313/586; 313/587

(58) Field of Classification Search ..... 345/37, 345/41, 60, 71; 315/169.4; 313/582–587
See application file for complete search history.

(56) References Cited

U.S. PATENT DOCUMENTS

2001/0006326 A1* 7/2001 Shirozu ..... 313/582
2003/0090443 A1* 5/2003 Kobayashi ..... 345/60
2004/0075388 A1* 4/2004 Miyashita et al. ..... 313/586
2004/0174120 A1* 9/2004 Fujitani ..... 313/586

* cited by examiner

*Primary Examiner*—Vip Patel
*Assistant Examiner*—Bumsuk Won
(74) *Attorney, Agent, or Firm*—Ked & Associates, LLP

(57) ABSTRACT

The present invention relates to a plasma display panel, and more particularly, to a plasma display panel and fabricating method thereof, by which brightness thereof is enhanced. According to an embodiment of the present invention, a plasma display panel includes a front substrate, a rear substrate confronting the front substrate, a pair of sustain electrodes formed parallel to each other on a confronting surface of the front substrate, a dielectric layer covering the confronting surface of the front substrate and a pair of the sustain electrodes, and a protective layer coated on the dielectric layer, wherein if the dielectric layer and the protective layer configure a functional layer, at least one or more trenches are formed in the functional layer. By the present invention, a discharge space having a high electric field concentrated thereon on discharge expands to increase ultraviolet ray density intensity, whereby more phosphor can be excited to raise brightness. And, if the discharge space expands, it is able to acquire a brightness level equal to that of the related art with a discharge initiation voltage at a level lower than that of the related art.

15 Claims, 5 Drawing Sheets

PLASMA DISPLAY PANEL HAVING TRENCHES IN FUNCTIONAL LAYER

This Nonprovisional application claims priority under 35 U.S.C. § 119(a) on Patent Application No. 10-2003-0102319 filed in Korea on Dec. 31, 2003, the entire contents of which are hereby incorporated by reference.

BACKGROUND OF THE INVENTION

1. Field of the Invention

The present invention relates to a plasma display panel, and more particularly, to a plasma display panel and fabricating method thereof, by which brightness thereof is enhanced.

2. Description of the Background Art

Generally, a plasma display panel (hereinafter abbreviated PDP), in which barrier ribs provided between front and rear glasses formed of soda-lime glass define one unit cell, is a device for implementing pictorial images. When inert gas such as He—Xe, He—Ne, or the like within each cell is discharged by RF voltage to generate vacuum ultraviolet rays, phosphor provided between the barrier ribs becomes luminous to implement the pictorial images or video. As the next generation display device, the PDP, which facilitates to enable its slim size and wide-screen and has such a feature as low power consumption and the like, is spotlighted.

PDP is classified into a DC type and an AC type according to an impressed drive voltage waveform and a discharge cell structure. The big difference between the AC and DC types lies in that external resistance for current restriction to prevent a discharge current from flowing during voltage impression should be provided to the DC type PDP having electrodes exposed to a discharge space. In case of the AC type PDP, a dielectric layer covers electrodes to naturally form capacitance enabling the current restriction and to protect the electrodes against ionic impact on discharge. Hence, endurance of the AC type PDP is superior to that of the DC type PDP. For such a reason, it is expected that PDP will adopt the AC drive type. And, the AC drive type PDP is driven in a manner of applying an AC voltage between electrodes having a dielectric inserted therein to trigger discharge each half cycle. Since the AC drive type PDP uses the dielectric, a surface of the dielectric is charged with electricity so that a memory effect can be brought about by a low impressed voltage using the electric charges. A configuration of the AC drive type PDP is shown in FIG. 1.

FIG. 1 is a perspective diagram of a PDP according to a related art. Referring to FIG. 1, a PDP 100 includes a front substrate 10 of an upper panel plate displaying images thereon and a rear substrate 20 of a lower panel plate forming a back face of the PDP 100. The front substrate 10 is assembled parallel to the rear substrate 20 to leave a prescribed distance from the rear substrate 20. Beneath the front substrate 10 of the upper panel plate, a sustain electrode 11 for sustaining light emission of a cell by mutual discharge in one pixel is provided. In doing so, a transparent electrode 11*a* formed of transparent ITO and a bus electrode 11*b* formed of a metal based material forms a pair to construct the sustain electrode 11. The sustain electrode 11 is covered with a dielectric layer 12 insulating electrode pairs from each other to restrict a discharge current. And, a protective layer 13 is formed by depositing MgO on the dielectric layer 12 to facilitate discharge conditions. A layout of the PDP upper plate is shown in FIG. 2.

On the rear substrate 20 of the lower panel plate, a plurality of stripe or well type barrier ribs 21 are arranged parallel to each other to define a plurality of discharge spaces, i.e., a plurality of cells. And, a plurality of address electrodes 22 for generating vacuum ultraviolet rays by performing address discharge in an intersection with the sustain electrode 11 each are arranged parallel to a plurality of the barrier ribs 21, respectively. An R/G/B phosphor layer 23 that emits visible rays for image display is coated on the rear substrate 20. A black matrix (not shown in the drawing), which is operative in cutting off light to reduce reflection by absorbing external light generated from outside the front substrate 10 and is also operative in enhancing color purity and contrast, is arranged on the barrier ribs 21. And, inert gas such as He+Ne, Ne+Xe, He+Xe+Ne, and the like is injected in the discharge spaces provided between the front substrate 10, the rear substrate 20, and the barrier ribs 21, respectively.

In the above-configured PDP, after the address discharge between the address electrode 22 of the rear substrate and the sustain electrode of the front substrate, continuous display discharge takes place for the selected cell. In doing so, vacuum ultraviolet rays generated from the discharge excite the phosphor to emit visible rays so that a specific image can be provided.

Specifically, in the AC drive type PDP, the image can be displayed by the sustain discharge following the confronting discharge. More specifically, in case that a voltage is applied to the address electrode 22 after voltage impression on the sustain electrode 11, the discharge, i.e., confronting discharge, occurs between the electrodes 22 and 11 to generate ultraviolet rays. And, the generated ultraviolet rays excite the phosphor 23 to emit the visible rays. Thereafter, as a sustain pulse is applied to the sustain electrode pair 11 to trigger the discharge, i.e., sustain discharge, the light emission of the confronting discharge is maintained to implement images.

FIG. 3 is a cross-sectional diagram of an upper plate according to a related art for explaining a discharge path. Referring to FIG. 3, a discharge path in maintaining the discharge by applying a voltage to the sustain electrode pair 11 on sustain discharge starts from an area (minimum discharge radius R) closest to the sustain electrode 11 and then extends to a distant area (maximum discharge radius R) according to an elapse of sustain discharge time. In doing so, as the area of the minimum discharge radius R has the maximum electric field strength, density of electrons and ions formed nearby becomes highest. Specifically, most of the electrons at high temperature (i.e., with high energy) exist in the area of the minimum discharge radius R. The high density of the electrons and ions increases the density of the ultraviolet rays exciting the phosphor 23, thereby increasing brightness. If the density of the electrons and ions is low, the density of the ultraviolet rays decreases to lower the brightness. Hence, in order to enhance the brightness, a level of the sustain voltage applied to the sustain electrode pair 11 is raised to increase the density of the electrons and ions generated from the sustain discharge.

However, since low voltage is applied to trigger the sustain discharge in the related art AC drive type PDP, it is unable to expect the brightness enhancement of the PDP according to the high voltage of the sustain discharge.

SUMMARY OF THE INVENTION

Accordingly, an object of the present invention is to solve at least the problems and disadvantages of the background art.

An object of the present invention is to provide a plasma display panel and fabricating method thereof, by which luminous brightness is enhanced and by which a drive voltage can be lowered.

According to an embodiment of the present invention, a plasma display panel includes a front substrate, a rear substrate confronting the front substrate, a pair of sustain electrodes formed parallel to each other on a confronting surface of the front substrate, a dielectric layer covering the confronting surface of the front substrate and a pair of the sustain electrodes, and a protective layer coated on the dielectric layer, wherein if the dielectric layer and the protective layer configure a functional layer, at least one or more trenches are formed in the functional layer.

According to an embodiment of the present invention, a method of fabricating a plasma display panel, which includes a front substrate, a rear substrate confronting the front substrate, a pair of sustain electrodes formed parallel to each other on a confronting surface of the front substrate, a dielectric layer covering the confronting surface of the front substrate and a pair of the sustain electrodes, and a protective layer coated on the dielectric layer wherein if the dielectric layer and the protective layer configure a functional layer, at least one or more trenches are formed in the functional layer, wherein in forming the functional layer, includes the steps of forming the dielectric layer to cover the confronting surface of the front substrate and a pair of the sustain electrodes, forming the trench in the dielectric layer between a pair of the sustain electrodes in a direction vertical to the confronting surface of the front substrate by masking, and forming the protective layer by depositing MgO on the dielectric layer having the trench formed therein and sidewalls of the trench.

According to an embodiment of the present invention, a method of fabricating a plasma display panel, which includes a front substrate, a rear substrate confronting the front substrate, a pair of sustain electrodes formed parallel to each other on a confronting surface of the front substrate, a dielectric layer covering the confronting surface of the front substrate and a pair of the sustain electrodes, and a protective layer coated on the dielectric layer wherein if the dielectric layer and the protective layer configure a functional layer, at least one or more trenches are formed in the functional layer, wherein in forming the functional layer, includes the steps of forming the dielectric layer to cover the confronting surface of the front substrate and a pair of the sustain electrodes, forming the trench by etching in a manner of applying a laser to the dielectric layer between a pair of the sustain electrodes in a direction vertical to the confronting surface of the front substrate, and forming the protective layer by depositing MgO on the dielectric layer having the trench formed therein and sidewalls of the trench.

By the present invention, a discharge space having a high electric field concentrated thereon on discharge expands to increase ultraviolet ray density intensity, whereby more phosphor can be excited to raise brightness. And, if the discharge space expands, it is able to acquire a brightness level equal to that of the related art with a discharge initiation voltage at a level lower than that of the related art.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
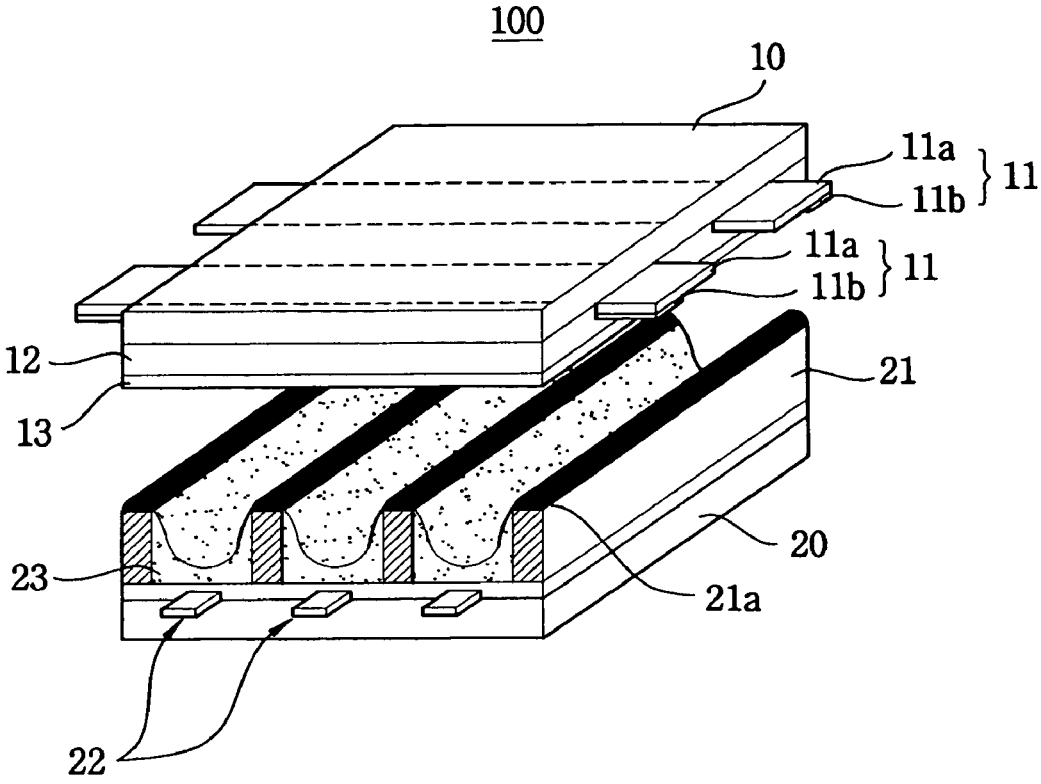
FIG. 1 is a perspective diagram of a PDP according to a related art.
Figure 2:
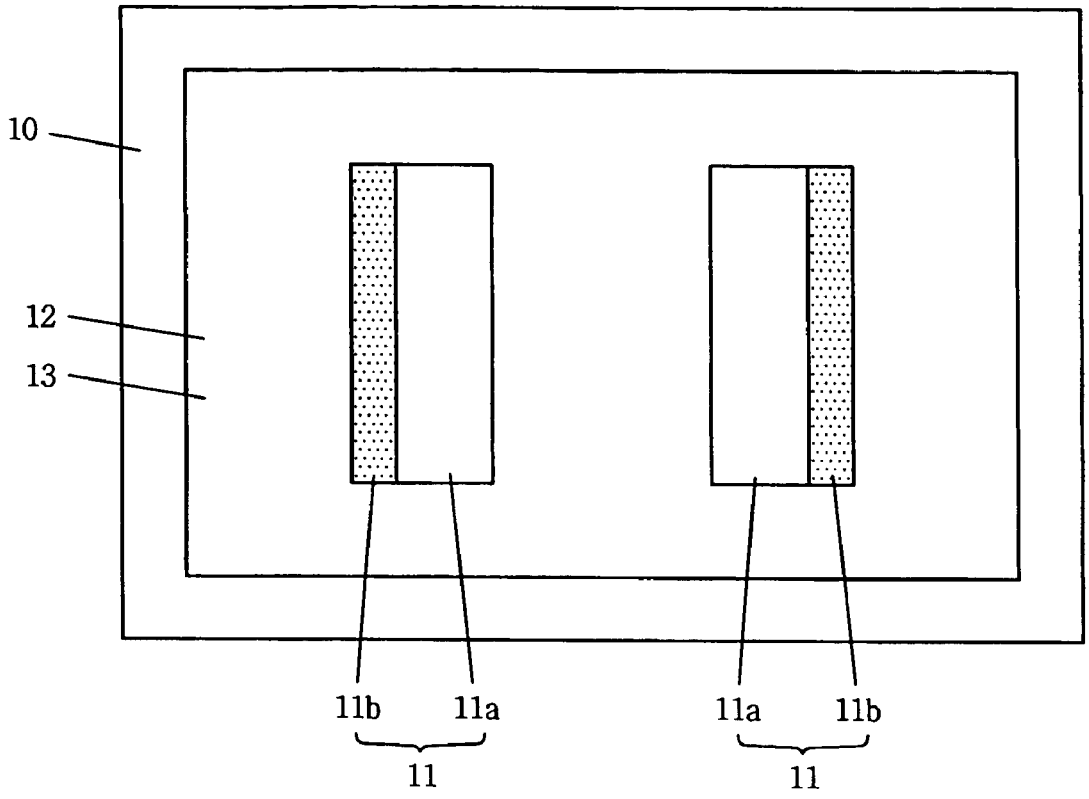
FIG. 2 is a layout of an upper plate of a PDP according to a related art.
Figure 3:
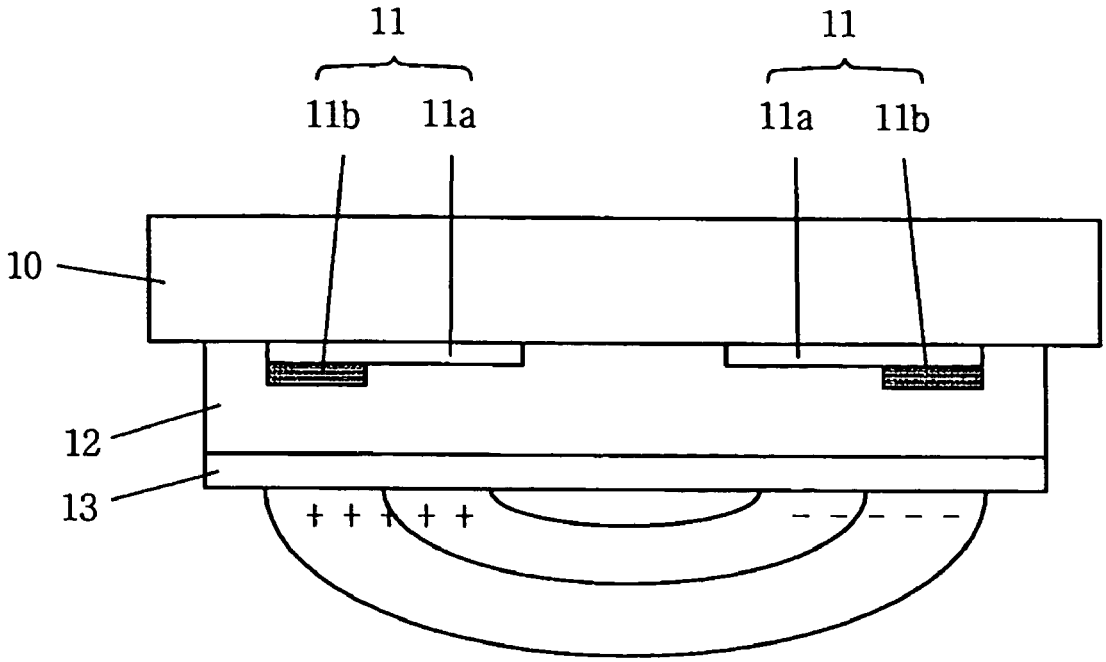
FIG. 3 is a cross-sectional diagram of an upper plate of a PDP according to a related art for explaining a discharge path.

Preferred embodiments of the present invention will be described in a more detailed manner with reference to the drawings.

According to an embodiment of the present invention, a plasma display panel includes a front substrate, a rear substrate confronting the front substrate, a pair of sustain electrodes formed parallel to each other on a confronting surface of the front substrate, a dielectric layer covering the confronting surface of the front substrate and a pair of the sustain electrodes, and a protective layer coated on the dielectric layer, wherein if the dielectric layer and the protective layer configure a functional layer, at least one or more trenches are formed in the functional layer.

The trench is formed between a pair of the sustain electrodes in a direction parallel to each of the sustain electrodes.

A depth of the trench is 5~30 μm.

A width of the trench is 10~50 μm.

The trenches are plurally formed in the functional layer.

The trenches differ from each other in depth and width each.

And, the trenches include a central trench formed between a pair of the sustain electrodes and neighbor trenches provided in the vicinity of the central trench and wherein the central trench is greater than each of the neighbor trenches in depth and width.

According to an embodiment of the present invention, a method of fabricating a plasma display panel, which includes a front substrate, a rear substrate confronting the front substrate, a pair of sustain electrodes formed parallel to each other on a confronting surface of the front substrate, a dielectric layer covering the confronting surface of the front substrate and a pair of the sustain electrodes, and a protective layer coated on the dielectric layer wherein if the dielectric layer and the protective layer configure a functional layer, at least one or more trenches are formed in the functional layer, wherein in forming the functional layer, includes the steps of forming the dielectric layer to cover the confronting surface of the front substrate and a pair of the sustain electrodes, forming the trench in the dielectric layer between a pair of the sustain electrodes in a direction vertical to the confronting surface of the front substrate by masking, and forming the protective layer by depositing MgO on the dielectric layer having the trench formed therein and sidewalls of the trench.

According to an embodiment of the present invention, a method of fabricating a plasma display panel, which includes a front substrate, a rear substrate confronting the front substrate, a pair of sustain electrodes formed parallel to each other on a confronting surface of the front substrate, a dielectric layer covering the confronting surface of the front substrate and a pair of the sustain electrodes, and a protective layer coated on the dielectric layer wherein if the dielectric layer and the protective layer configure a functional layer, at least one or more trenches are formed in the functional layer, wherein in forming the functional layer, includes the steps of forming the dielectric layer to cover the confronting surface of the front substrate and a pair of the sustain electrodes, forming the trench by etching in a manner of applying a laser to the dielectric layer between a pair of the sustain electrodes in a direction vertical to the confronting surface of the front substrate, and forming the protective layer by depositing MgO on the dielectric layer having the trench formed therein and sidewalls of the trench.

Hereinafter, the embodiments of the present invention will be described with reference to the drawings.

Figure 4:
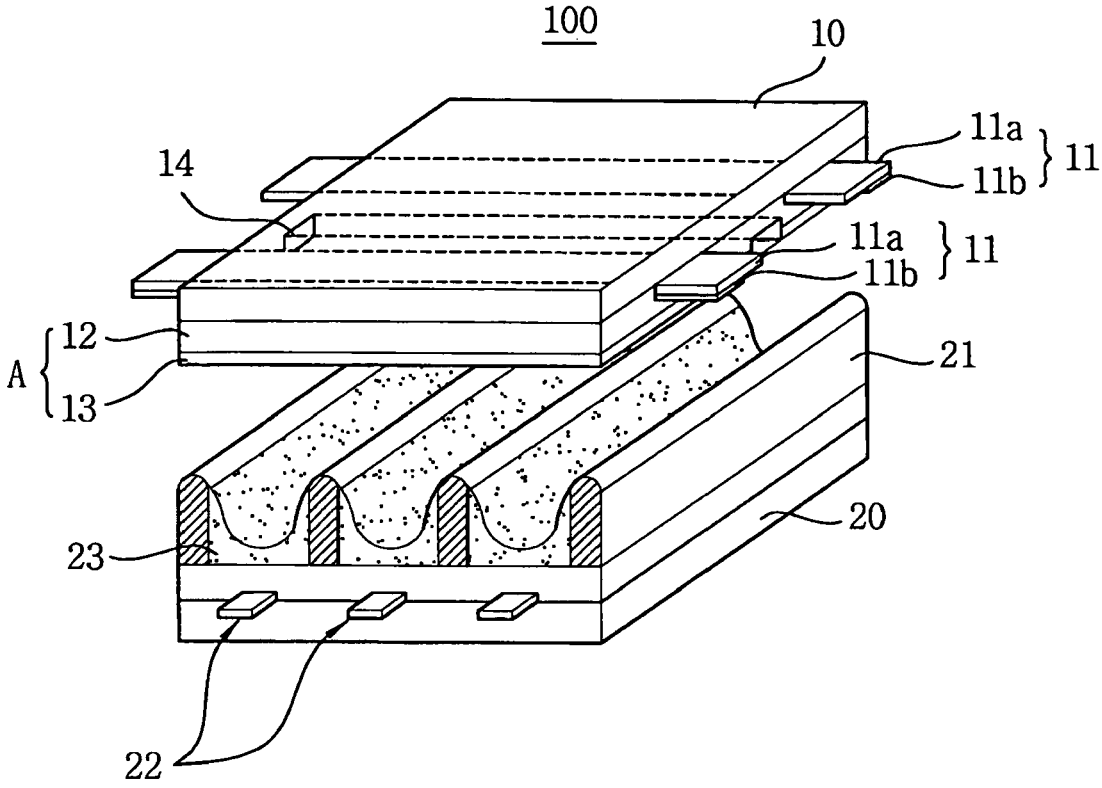
FIG. 4 is a perspective diagram of a PDP according to the present invention.

FIG. 4 is a perspective diagram of a PDP according to the present invention. Referring to FIG. 4, a PDP 100 according to the present invention includes a front substrate 10 of an upper panel plate displaying images thereon and a rear substrate 20 of a lower panel plate. The front substrate 10 is assembled parallel to the rear substrate 20 to leave a prescribed distance from the rear substrate 20.

Beneath the front substrate 10 of the upper panel plate, a sustain electrode 11 for sustaining light emission of a cell by mutual discharge in one pixel is provided. In doing so, a transparent electrode 11*a* formed of transparent ITO and a bus electrode 11*b* formed of a metal based material forms a pair to construct the sustain electrode 11. The sustain electrode 11 is covered with a dielectric layer 12 insulating electrode pairs from each other to restrict a discharge current. And, a protective layer 13 is formed by depositing MgO on the dielectric layer 12 to facilitate discharge conditions. In the present invention, the dielectric and protective layers 12 and 13 stacked on the front substrate are called a functional layer A. On the rear substrate 20 of the lower panel plate, a plurality of stripe or well type barrier ribs 21 are arranged parallel to each other to define a plurality of discharge spaces, i.e., a plurality of cells. And, a plurality of address electrodes 22 for generating vacuum ultraviolet rays by performing address discharge in an intersection with the sustain electrode 11 each are arranged parallel to a plurality of the barrier ribs 21, respectively. An R/G/B phosphor layer 23 that emits visible rays for image display is coated on the rear substrate 20. A black matrix (not shown in the drawing), which is operative in cutting off light to reduce reflection by absorbing external light generated from outside the front substrate 10 and is also operative in enhancing color purity and contrast, is arranged on the barrier ribs 21.

In the above-configured PDP according to the present invention, the dielectric layer 12 is formed on the transparent electrode 11*a* and the bus electrode 11*b* by screen printing. In doing so, a trench 14 is formed in the dielectric layer 12 in a direction vertical to the front substrate and MgO is then deposited on the dielectric layer 12 to form the protective layer 13.

Figure 5:
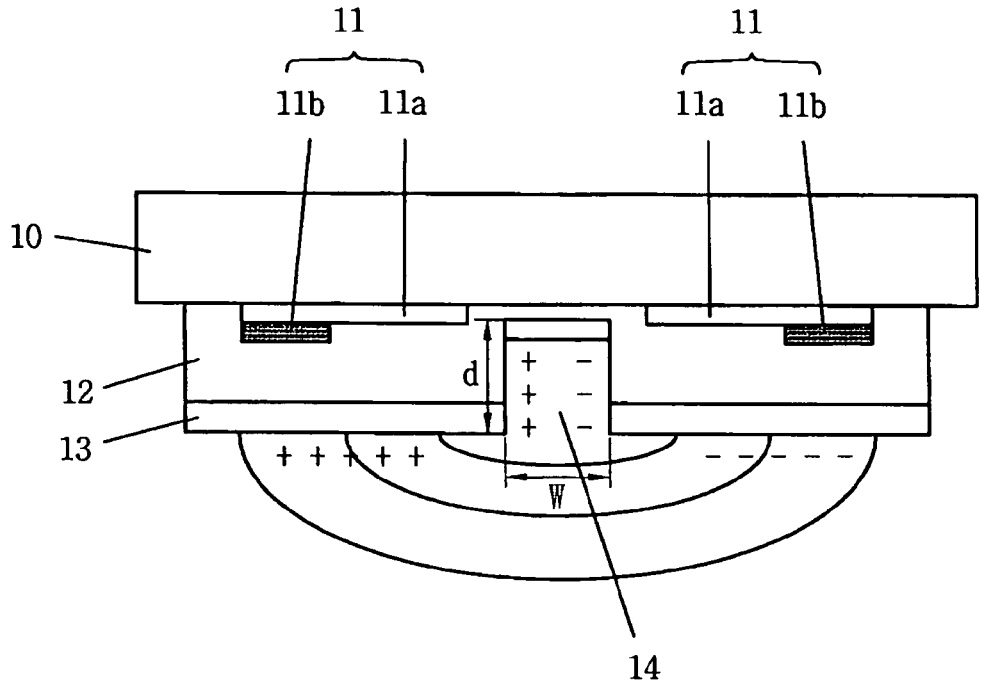
FIG. 5 is a cross-sectional diagram of an upper plate of a PDP according to the present invention.

FIG. 5 is a cross-sectional diagram of an upper plate of a PDP according to the present invention. Referring to FIG. 5, in a configuration of the upper plate of the PDP, the trench 14 is formed in the functional layer A, which consists of the dielectric layer 12 and the protective layer 13, in the vertical direction to the front substrate 10. Specifically, the trench 14 is formed between the sustain electrode pairs 11 adjacent to each other in a direction parallel to the sustain electrode 11.

A method of fabricating an upper plate of the above-configured PDP according to the present invention is explained as follows. First of all, a dielectric is coated on the front substrate having the sustain electrode pairs 11 formed thereon to form the dielectric layer 12. Subsequently, the trench 14 is formed in the dielectric layer 12 over a middle portion between the sustain electrode pairs 11 adjacent to each other in a direction vertical to the front substrate by masking. Thereafter, Mgo is deposited on the dielectric layer 12 including sidewalls of the trench 14 to form the protective layer.

Another method of fabricating an upper plate of the above-configured PDP according to the present invention is explained as follows. First of all, a dielectric layer is coated on the front substrate having the sustain electrode pairs 11 formed thereon to form the dielectric layer 12. Subsequently, the dielectric layer 12 over a middle portion between the sustain electrode pairs 11 adjacent to each other is etched in a direction vertical to the front substrate using laser or the like to form the trench 14. Thereafter, Mgo is deposited on the dielectric layer 12 including sidewalls of the trench 14 to form the protective layer.

After the confronting discharge is performed by the impression of a prescribed voltage, the PDP including the functional layer having the trench formed therein triggers the sustain discharge by the impression of the sustain pulse on the sustain electrode pairs to maintain the corresponding light emission. Considering the sustain discharge path, the sustain discharge starts from an area closest to the sustain electrode 11 and then extends to a distant area according to an elapse of sustain discharge time. In doing so, the trench provided to the functional layer works as a new discharge space to play a role as a discharge space having a high electric field concentrated thereon. Namely, most of electrons with high energy are concentrated on the trench to intensively bring about the ionization and excitation so that powerful ultraviolet rays can excite the phosphor, whereby brightness is enhanced. Hence, it is preferable that the trench is formed deeper to expand the discharge space having the electric field concentrated thereon in the trench provided to the functional layer. By taking such a fact into consideration, a depth d of the trench is defined to lie within a range of 5~30 μm. Moreover, a width w of the trench is defined to lie within a range of 10~50 μm.

Figure 6:
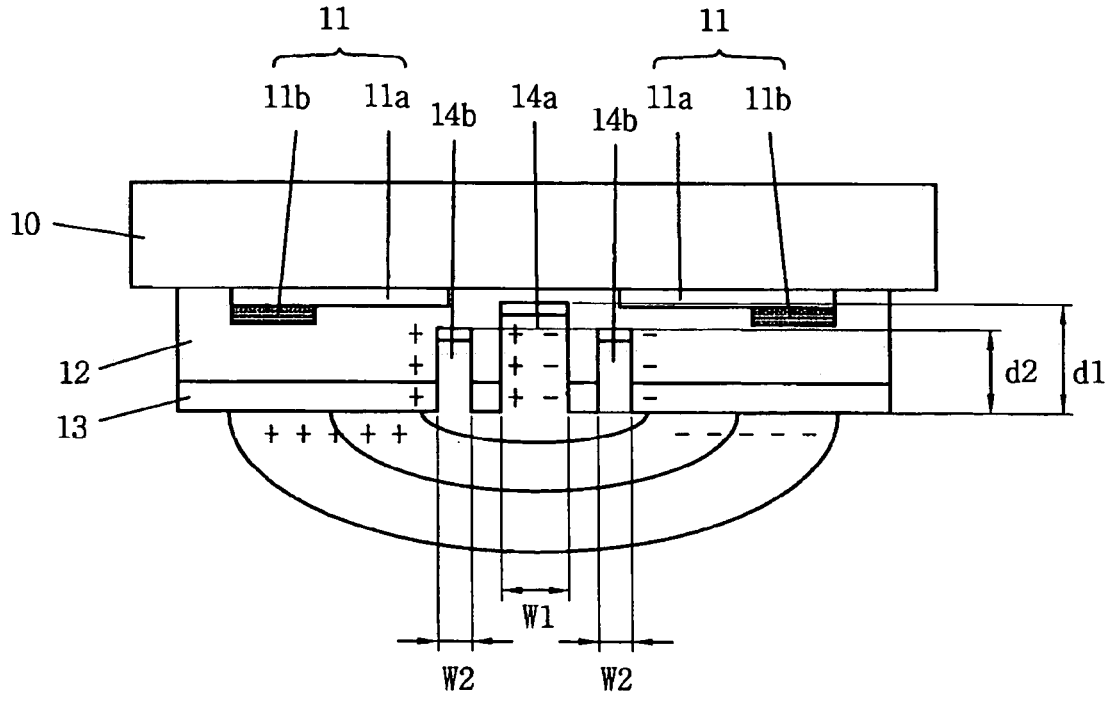
FIG. 6 is a cross-sectional diagram of another upper plate of a PDP according to the present invention.

FIG. 6 is a cross-sectional diagram of another upper plate of a PDP according to the present invention. Referring to FIG. 6, in a configuration of an upper plate of PDP, a plurality of trenches 14 are formed in the functional layer A consisting of the dielectric layer 12 and the protective layer 13 in the direction vertical to the front substrate. In this case, a plurality of the trenches 14 include a central trench 14*a* and neighbor trenches 14*b*. And, a depth d1 and width w1 of the central trench 14*a* are formed greater than a depth d2 and width w2 of each of the neighbor trenches 14*b*, respectively. In the above-explained configuration of the PDP upper plate, a discharge space having a high electric field concentrated thereon on discharge expands to increase ultraviolet ray density intensity, whereby more phosphor can be excited to raise brightness.

Moreover, if the discharge space expands, it is able to acquire a brightness level equal to that of the related art with a discharge initiation voltage at a level lower than that of the related art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel comprising:

a front substrate;

a rear substrate confronting the front substrate;

a pair of sustain electrodes formed parallel to each other on a surface of the front substrate;

a dielectric layer on the surface of the front substrate and the pair of the sustain electrodes;

a protective layer coated on the dielectric layer; and at least two trenches formed in the dielectric layer and the protective layer and including two trenches of the at least two trenches differing in depth and width from one another.

2. The plasma display panel of claim 1, wherein the at least two trenches are formed between the pair of the sustain electrodes in a direction parallel to each of the sustain electrodes.

3. The plasma display panel of claim 1 or claim 2, wherein at least one of the two trenches has a depth of 5~30 μm.

4. The plasma display panel of claim 1 or claim 2, wherein at least one of the two trenches has a depth of 10~50 μm.

5. The plasma display panel of claim 1, wherein the at least two trenches comprise a central trench formed between the pair of the sustain electrodes and neighbor trenches provided in a vicinity of the central trench and wherein the central trench has a larger depth than each of the neighbor trenches and the central trench has a larger width than each of the neighbor trenches.

6. The plasma display panel of claim 1, wherein the at least two trenches extend into the protective layer and the dielectric layer without extending into the front substrate.

7. The plasma display panel of claim 1, wherein the at least two trenches are provided in the dielectric layer and the protective layer at an area between adjacent pairs of the sustain electrodes.

8. The plasma display panel of claim 1, wherein the protective layer is provided on sidewalls of the at least two trenches.

9. A plasma display panel comprising:

a front substrate;

a rear substrate;

a pair of sustain electrodes formed on the front substrate facing the rear substrate;

a dielectric layer on the pair of the sustain electrodes;

a protective layer on the dielectric layer;

a first trench formed in the dielectric layer and the protective layer and extending to a bottom surface, wherein a portion of the dielectric layer is provided between the bottom surface of the first trench and the front substrate;

a second trench formed in the dielectric layer and the protective layer; and a third trench formed in the dielectric layer and the protective layer, wherein the first trench has a greater depth into the dielectric layer than the second trench or the third trench.

10. The plasma display panel of claim 9, wherein the first trench is formed in an area between the pair of the sustain electrodes.

11. The plasma display panel of claim 9, wherein the first trench extends into the dielectric layer and the protective layer to a depth of 5~30 μm.

12. The plasma display panel of claim 9, wherein the first trench has a width of 10~50 μm.

13. The plasma display panel of claim 9, wherein the first trench has a greater width in the dielectric layer than the second trench or the third trench.

14. A plasma display panel comprising:

a first substrate;

a pair of sustain electrodes on the first substrate;

a dielectric layer on the pair of the sustain electrodes;

a protective layer on the dielectric layer;

at least one trench formed in the dielectric layer at an area of the dielectric layer between the pair of sustain electrodes such that a portion of the dielectric layer is provided between the trench and the first substrate;

a second trench formed in the dielectric layer and the protective layer; and a third trench formed in the dielectric layer and the protective layer.

wherein the at least one trench has a greater depth into the dielectric layer than the second trench or the third trench.

15. The plasma display panel of claim 14, wherein the at least one trench has a greater width in the dielectric layer than the second trench or the third trench.

* * * * *